United States Patent [19]

Maxson et al.

[11] 3,992,272

[45] Nov. 16, 1976

[54] SUBMERGED OFFSHORE PLATFORM JOINT PROTECTION

[75] Inventors: Orwin G. Maxson; Marvin L. Peterson, both of Ponca City, Okla.

[73] Assignee: Continental Oil Company, Ponca City, Okla.

[22] Filed: May 29, 1975

[21] Appl. No.: 582,416

[52] U.S. Cl. ..... 204/147; 204/148; 204/196; 204/197; 61/54

[51] Int. Cl.[2] ..... C23F 13/00; E02D 5/22

[58] Field of Search ..... 204/147, 148, 196, 197; 61/54

[56] References Cited

UNITED STATES PATENTS

| | | | |
|---|---|---|---|
| 2,187,316 | 1/1940 | Greulich | 61/56 |
| 2,273,897 | 2/1942 | Scott | 204/147 |
| 2,428,070 | 9/1947 | Frenkil | 61/54 |
| 2,454,956 | 11/1948 | Young | 204/197 |
| 2,620,633 | 12/1952 | Gerwick | 61/54 |
| 2,752,308 | 6/1956 | Andrus | 204/196 |
| 2,866,742 | 12/1958 | Sutton | 204/197 |
| 2,890,157 | 6/1959 | Raetzsch | 204/196 |
| 3,707,450 | 12/1972 | Townsend | 204/147 |

FOREIGN PATENTS OR APPLICATIONS

| | | | |
|---|---|---|---|
| 980,690 | 1/1965 | United Kingdom | 204/196 |

OTHER PUBLICATIONS

"Chem. Tech.," Feb., 1973, pp. 105–108.

*Primary Examiner*—T. Tung

*Attorney, Agent, or Firm*—Cortlan R. Schupbach, Jr.

[57] ABSTRACT

Submerged offshore steel platform joints are coated with concrete with the steel members between concrete-covered joints protected cathodically to prevent corrosion and corrosion fatigue. The combination allows more economical cathodic protection and extends the useful life of the submerged joints of the offshore structure.

7 Claims, 2 Drawing Figures

SUBMERGED OFFSHORE PLATFORM JOINT PROTECTION

Figure 1:
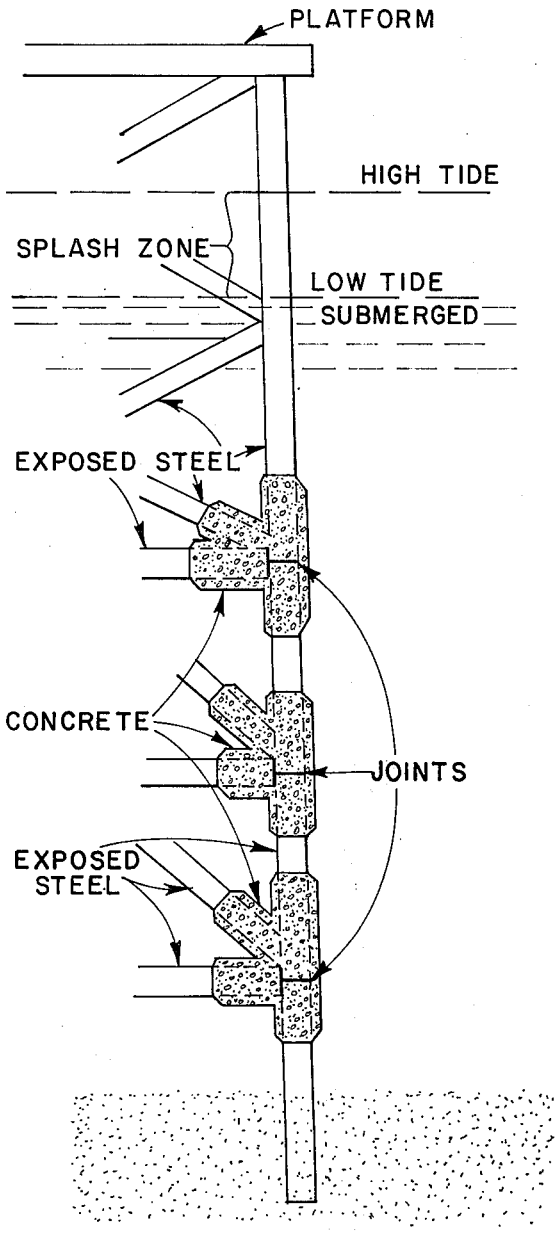

This invention relates to a method for protecting welded joints of offshore steel platforms from corrosion. More particularly, this invention relates to an improved method for preventing the corrosion of submerged joints of offshore steel platforms.

Exploration for minerals beneath bodies of water requires the use of offshore platforms. These platforms must be firmly supported to withstand the often violent weather conditions which prevail. These supports normally take the form of large steel pipes which extend from the platform to a point on the bottom of the lake or ocean floor. These members are normally of steel, and steel will corrode locally in areas of welds or of stress. Other pipes or risers, flow lines, and the like extend at least some distance beneath the surface of the water. These steel members can also be coated in accordance with the present invention.

Severe corrosion problems are usually encountered with submerged offshore steel supports and flow lines. Such corrosion problems are especially severe in the joint or weld areas of the submerged steel supports. Corrosion in such localized areas may be extremely rapid when compared to the corrosion of the remainder of this steel support.

Steel corrosion is an electrochemical process. Steel will not corrode at a high pH (11 to 13). Corrosion and corrosion fatigue will not occur at the concrete-coated joints of the present invention. The concrete coated areas will draw less current from the cathodic system, thus lowering anode (or power) requirements. The resulting economy will be significant over a period of time. A low potential, low current density cathodic system will protect the uncoated portion of the platform members since the high requirement joint regions are protected by the concrete coating and require less current from the cathodic system. The concrete coating could, of course, be extended to cover all submerged structural support, but naturally maximum economy will dictate concrete cover only the joints and cathodic protection be used to prevent corrosion of the uncoated structure. Such a combination gives minimum resistance to wave action and maximum economy of energy expended.

Many methods of protection have been tried in the past. One means of protection known to the art employs sacrificial anodes. Such anodes are inserted on or near the metal member, and a portion of the corrosion is thus transferred to the more readily corroded anode. While sacrificial anodes are satisfactory for some applications, in areas of high wind or wave action, the anodes are of such size or of such number that they offer significant resistance to the action of waves and thus add extra stress to the support. Another method used is that of an impressed current on the steel member. These currents are used to combat the electronegative force which is the means of steel corrosion and thus slow or prohibit corrosion. The disadvantage of such cathodic protection systems is that reliable continuous sources of electrical power are required to protect the steel from corrosion and corrosion fatigue.

Another means of protection known to the art is employing a jacket of some noncorrodible material around the support. Normally, such jackets encompass the structure in the area of the splash zone. These methods are largely unsatisfactory because of probable damage to the noncorrodible material, allowing water to penetrate to the steel and the rapid corrosion beneath the surrounding jacket.

It is clearly seen that all the presently known means of protection suffer from some disadvantage. The solution provided by this invention overcomes many of the disadvantages of the prior art by providing an economical and effective method for the protection of joint areas of submerged members supporting offshore platforms.

Briefly, the invention comprises coating the joint, which will be submerged, with concrete and then impressing a current or alternatively applying a sacrificial anode on the metal support member before submerging the metal support member. The presence of the concrete coating will reduce the required cathodic current.

More particularly, the invention comprises an improved method for protecting a submerged joint for steel support members of offshore platforms from corrosion comprising:

1. Determining which joints will be submerged,
2. Coating the joint with concrete over a predetermined length,
3. Installing the offshore platform such that the coated joint is submerged, and
4. Supplying impressed current or sacrificial anodes on the joint, said current being at a level necessary to protect the uncoated steel.

It is thus seen that the disadvantages of a solid coating over the entire length of the support member are obviated. Also, the use of an extra high current in order to protect the easily corrodible welded steel and stress points of the joint is also obviated. The combination of coating the submerged joint with concrete and impressing only sufficient current to protect the exposed areas of the steel results in a savings in weight, in that the entire platform need not be coated with concrete, and a savings in electrical potential, in that a greatly reduced current is needed to prevent corrosion of the intermediate steel portions between joints.

In order to particularly describe the foregoing invention, reference is made to the attached drawings.

It can be seen in FIG. 1 that concrete jackets are placed over the weld areas or joint areas of the support member over the entire length of the submerged piling. Cathodic current is then supplied over the joint and maintained at a proper level to prevent corrosion of the exposed steel between the concrete coverings.

Figure 2:
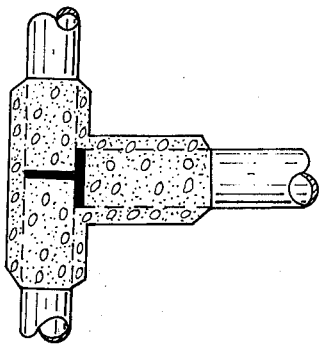

FIG. 2 shows a localized view of an upright support joining a lateral support.

It is, therefore, an object of the present invention to provide an improved method for protecting submerged joint regions on steel supports of offshore platforms. Other objects will become apparent to those skilled in this art as the description proceeds.

As described above, the current practice is to coat the splash zone and atmospheric exposed areas of the support members with coatings well known to those skilled in this art. The submerged portions of the structures are normally protected either by completely encasing in a protective material and/or by cathodic systems. The cathodic systems used either impressed current or sacrificial anodes. The most critical areas are the joint areas, which are the hardest to protect with cathodic systems because of crevice and shadow effects. Shadow effects are those effects which prevent effective cathodic protection in some areas of corrosion because of current flow. Therefore, cathodic potentials and currents requirements for the entire support member are higher than necessary to protect the non-joint areas alone in order to give sufficient protection to these critical joint regions. Such current potentials are expensive and unnecessary using the process of the present invention.

The joint regions below the waterline of support members will be coated with concrete before installation in the water. Although many types of concrete are available and the composition can vary widely, the preferred compositions will include pozzolan or fly ash in admixtures with the concrete to limit extraction or leaching by the water. Another preferred embodiment includes polymeric latexes to increase the flexibility and improve the bonding of the concrete to the steel. Also encompassed within the present invention are polymeric fibers for reinforcement of the concrete coating. Polymeric fibers are preferred over metal reinforcement because of their noncorrosive nature.

The corrosion prevention effects of concrete alone are well known to the prior art. Concrete has a pH of 11 or more which prevents corrosion of steels. However, the high pH protects only when in intimate contact with the steel. Steel requires a potential of more than −750 millivolts in order to prevent corrosion in the ocean environment. The result of concrete surrounding steel acts much as does a sacrificial anode. The concrete, in fact, will degrade slowly over a period of time as the lime ($CaCO_3$) in the concrete is leached out by the water.

In order to prevent cracking and trapping of air bubbles against the steel and the subsequent increase in corrosion, the concrete use in the present invention includes from 25 to 50 percent by weight of the material such as pozzolan or fly ash which reacts with the concrete to improve the tensile strength over a period of time. A preferred concrete would include a rubber latex used in place of a portion of the water. Normally, up to 50 percent of the water can be replaced by a rubber latex. The rubber latex can contain up to 50 weight percent solids of polymeric material.

Representative examples of rubber latexes useful in the practice of the present invention are styrene/-butadiene latex, vinyl acetate latex, polybutadiene latex, acrylic/butadiene latex, vinyl/vinylidene chloride latex, and butyl latex.

Before the concrete is applied to the joint area, the steel is preferably sandblasted or otherwise treated to white bare steel before application. While this is not considered critical to the process of the present invention, greatly improved results will be obtained if this elementary preparation is observed. Concrete is then troweled or sprayed onto the steel members for a longitudinal distance of from 1 to 2 support member diameters from the welded joint. About 1 to 1.5 diameters of the support member on either side of the joint is the preferred distance of application. Concrete thickness on the support member can vary from 0.25 inch to 1.00 inch. Preferred thicknesses will be from 0.40 inch to 0.60 inch. The most preferred is 0.50 inch.

Concrete bonded to steel produces a chemical environment with a high pH at the interface of the bond. Cathodic potentials in seawater also produce a chemical environment with a high pH at the steel surface by creating a coating composed primarily of $CaCO_3$ and $Mg(OH)_2$. The high pH associated with cathodic potentials will attack many organic and polymeric coatings which result in disbonding or blistering of the coating. Such results are not found with concrete.

While certain embodiments and details have been shown for the purpose of illustrating this invention, it will be apparent to those skilled in this art that various changes and modifications may be made herein without departing from the spirit or the scope of the invention.

Having described the invention, we claim:

1. A method for protecting submerged steel joint sections of steel support members for offshore platforms comprising: a) prior to immersion placing concrete around the joint sections that will be submerged, said concrete containing pozzolan, the liquid component of the concrete containing up to 50 percent by weight of a polymeric latex and wherein the concrete is applied after cleaning the steel to a white finish, said application being from 0.25 to 1.00 inches thick and wherein the concrete extends from 1 to 2 support member diameters on either side of the covered joint, said concrete in addition containing polymeric reinforcement; b) allowing the concrete to set sufficiently to maintain adhesion to the support member; c) immersing the section having the concrete covered joints; and d) placing sufficient cathodic protection on the support member to inhibit corrosion in sections not covered by concrete.

2. A method as described in claim 1 wherein the polymeric latex is styrene butadiene.

3. A method as described in claim 1 wherein the polymeric latex is polybutadiene latex.

4. A method as described in claim 1 wherein the polymeric latex is vinyl acetate latex.

5. A method as described in claim 1 wherein the polymeric latex is vinyl-vinylidene chloride latex.

6. A method as described in claim 1 wherein the cathodic protection is derived from an impressed current.

7. A method as described in claim 1 wherein the cathodic protection is derived from a sacrificial anode.

* * * * *